US011125517B2

(12) United States Patent
Shreve

(10) Patent No.: US 11,125,517 B2
(45) Date of Patent: Sep. 21, 2021

(54) MAGAZINE WITH GUARD ELEMENT

(71) Applicant: C Products Defense, Inc., Bradenton, FL (US)

(72) Inventor: Bernie Shreve, Lakewood Ranch, FL (US)

(73) Assignee: C PRODUCTS DEFENSE, INC., Bradenton, FL (US)

( * ) Notice: Subject to any disclaimer, the term of this patent is extended or adjusted under 35 U.S.C. 154(b) by 0 days.

(21) Appl. No.: 16/774,572

(22) Filed: Jan. 28, 2020

(65) Prior Publication Data

US 2021/0231395 A1 Jul. 29, 2021

(51) Int. Cl.
*F41A 9/65* (2006.01)
*F41A 9/70* (2006.01)

(52) U.S. Cl.
CPC .. *F41A 9/65* (2013.01); *F41A 9/70* (2013.01)

(58) Field of Classification Search
CPC ..... F41A 9/24; F41A 9/61; F41A 9/64; F41A 9/65
USPC ..... 42/49.01, 50, 49.1; 89/33.1
See application file for complete search history.

(56) References Cited

U.S. PATENT DOCUMENTS 506,323 A * 10/1893 Lee ..... F41A 9/65 42/50
1,348,172 A * 8/1920 Hammond ..... F41A 9/65 42/50
2,185,676 A * 1/1940 Alphonse Moneta .... F41A 9/69 42/49.01
3,772,812 A * 11/1973 Day ..... F41A 9/71 42/7
D241,837 S * 10/1976 Sofinowski III, et al. .. D22/108
4,888,899 A * 12/1989 Chesnut ..... F41A 9/70 42/50
5,357,703 A * 10/1994 Chesnut ..... F41A 17/38 42/50
5,507,110 A * 4/1996 Chesnut ..... F41A 9/65 42/50
8,590,203 B1 * 11/2013 McCarthy ..... F41A 35/02 42/96
10,480,880 B2 * 11/2019 Thomele ..... F41A 9/70
10,801,792 B2 * 10/2020 Pini ..... F41A 9/65
2006/0096145 A1 * 5/2006 Gussalli Beretta ..... F41A 17/38 42/50
2010/0101132 A1 * 4/2010 Jacobson ..... F41A 9/65 42/50

(Continued)

*Primary Examiner* — Derrick R Morgan
(74) *Attorney, Agent, or Firm* — Bennet K. Langlotz; Langlotz Patent & Trademark Works, LLC

(57) ABSTRACT

Magazines with guard elements have a tubular body having a lower end and an upper end and defining an interior space, the body having opposed lateral sidewalls, and opposed front and rear walls, at an intermediate portion along the length of the body between the upper and lower ends, a sidewall defining a magazine catch opening, the magazine catch opening having an upper limit including a downwardly-facing ledge surface configured to engage a latch, and a recessed guard element at the magazine catch opening configured to prevent intrusion of the firearm latch into the interior space. The recessed guard element may protrude into the interior space. The tubular body may have a wall thickness adjacent to the recessed guard element, and the recessed guard element may have the same wall thickness. The tubular body may be formed of an articulated sheet.

14 Claims, 5 Drawing Sheets

(56) References Cited

U.S. PATENT DOCUMENTS

| | | | | |
|---|---|---|---|---|
| 2011/0107639 | A1* | 5/2011 | Douglas | F41A 9/67<br>42/50 |
| 2011/0167694 | A1* | 7/2011 | Bigley | F41A 9/70<br>42/50 |
| 2012/0260791 | A1* | 10/2012 | Kerbrat | F41A 17/38<br>89/1.4 |
| 2013/0185974 | A1* | 7/2013 | Colmano | F41A 9/61<br>42/49.1 |
| 2016/0172876 | A1* | 6/2016 | Stewart | H02J 7/0045<br>320/114 |
| 2017/0138685 | A1* | 5/2017 | Beasley | F41A 9/71 |
| 2017/0146308 | A1* | 5/2017 | Plumb | F41A 35/00 |
| 2018/0128570 | A1* | 5/2018 | Sawicki | F41A 9/65 |
| 2019/0154390 | A1* | 5/2019 | DiLeo | F41A 35/02 |
| 2019/0162495 | A1* | 5/2019 | Muller | F41A 9/66 |
| 2019/0195584 | A1* | 6/2019 | Thomele | F41A 9/69 |
| 2019/0226781 | A1* | 7/2019 | Derus | F41A 9/83 |
| 2020/0284537 | A1* | 9/2020 | Plate | F41A 9/70 |

* cited by examiner

MAGAZINE WITH GUARD ELEMENT

FIELD OF THE INVENTION

The present invention relates to firearms, and more particularly to a magazine for a box magazine.

BACKGROUND OF THE INVENTION

A magazine is an ammunition storage and feeding device within, or attached to, a repeating firearm. The magazine functions by moving the cartridges stored in the magazine into a position where they may be chambered by the action of the firearm. Most magazines designed for use with a reciprocating bolt firearm utilize a set of feed lips which stops the vertical motion of the cartridges out of the magazine but allows one cartridge at a time to be pushed forward (stripped) out of the feed lips by the firearm's bolt into the chamber.

Some form of spring and follower combination is almost always used to feed cartridges to the lips, which can be located either in the magazine (most removable box magazines) or built into the firearm (fixed box magazines). As the firearm cycles, cartridges are moved to the top of the magazine by a follower driven by spring compression to a feed position. In most firearms, the magazine follower engages a slide-stop to hold the slide back and keep the firearm out of battery when the magazine is empty, and all rounds have been fired. Box magazines may be integral to the firearm or removable.

A detachable box magazine is a self-contained mechanism capable of being loaded or unloaded while detached from the host firearm. They are inserted into a magazine well in the firearm receiver usually below the action, but occasionally positioned to the side or on top. When the magazine is empty, it can be detached from the firearm and replaced by another full magazine. This significantly speeds the process of reloading, allowing the operator quick access to ammunition.

Conventional rifle or pistol box magazines have a magazine catch with an open void rectangular feature near the front wall. The purpose of the magazine catch is to provide a feature for a magazine latch on the host firearm to engage to ensure retention of the magazine inside the firearm's magazine well. In order to remove the magazine from the host firearm, a push button located on the firearm's body releases the magazine latch from the magazine catch to enable removal of the magazine from the magazine well when the push button is fully depressed.

Some firearms, particularly rifles, have especially aggressive magazine latches that can overextend past the magazine catch and protrude into the interior space of the magazine. If the magazine latch protrudes sufficiently far into the interior space of the magazine, the magazine latch can interfere with movement of the follower and ammunition within the interior space, which is undesirable.

Therefore, a need exists for a new and improved magazine with guard element that prevents a magazine latch from interfering with movement of the follower and ammunition within the interior space of the magazine. In this regard, the various embodiments of the present invention substantially fulfill at least some of these needs. In this respect, the magazine with guard element according to the present invention substantially departs from the conventional concepts and designs of the prior art, and in doing so provides an apparatus primarily developed for the purpose of providing a magazine with guard element that prevents a magazine latch from interfering with movement of the follower and ammunition within the interior space of the magazine.

SUMMARY OF THE INVENTION

The present invention provides an improved magazine with guard element, and overcomes the above-mentioned disadvantages and drawbacks of the prior art. As such, the general purpose of the present invention, which will be described subsequently in greater detail, is to provide an improved magazine with guard element that has all the advantages of the prior art mentioned above.

To attain this, the preferred embodiment of the present invention essentially comprises a tubular body having a lower end and an upper end and defining an interior space, the body having opposed lateral sidewalls, and opposed front and rear walls, at an intermediate portion along the length of the body between the upper and lower ends, a sidewall defining a magazine catch opening, the magazine catch opening having an upper limit including a downwardly-facing ledge surface configured to engage a latch, and a recessed guard element at the magazine catch opening configured to prevent intrusion of the firearm latch into the interior space. The recessed guard element may protrude into the interior space. The tubular body may have a wall thickness adjacent to the recessed guard element, and the recessed guard element may have the same wall thickness. The tubular body may be formed of an articulated sheet. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
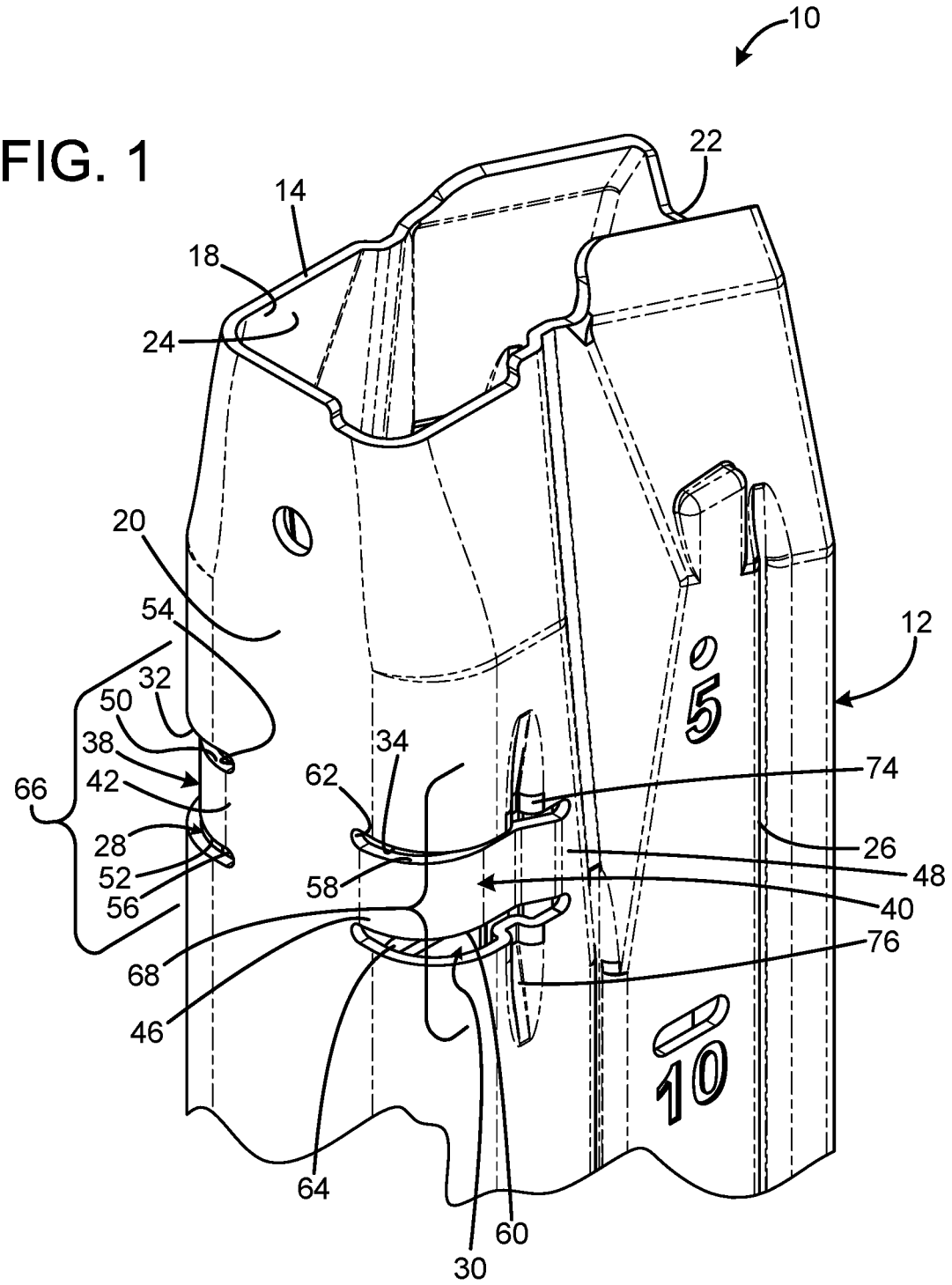
FIG. 1 is a top isometric fragmentary view of the current embodiment of the magazine with guard element constructed in accordance with the principles of the present invention.
Figure 2:
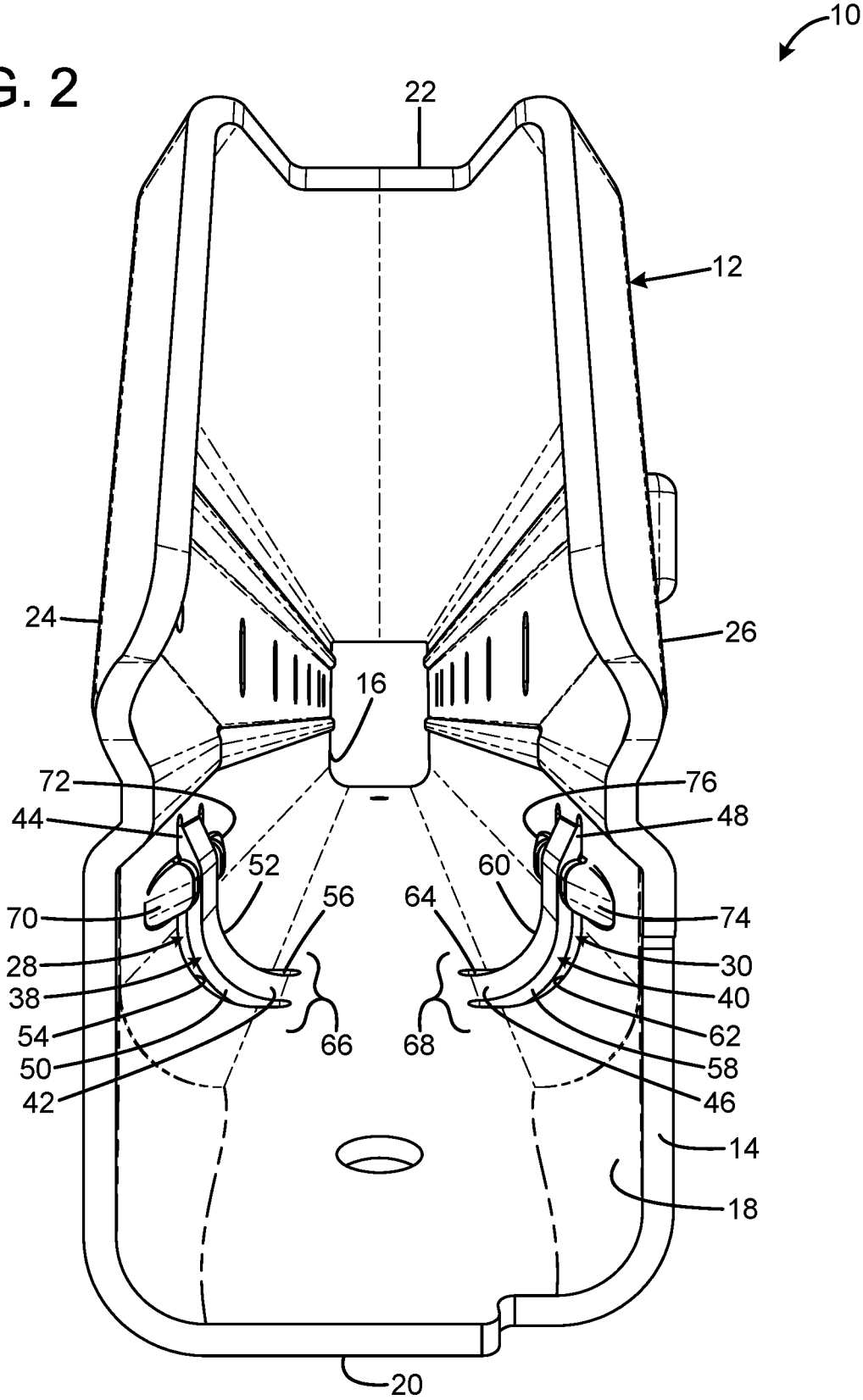
FIG. 2 is a top perspective view of the magazine with guard element of FIG. 1.
Figure 3:
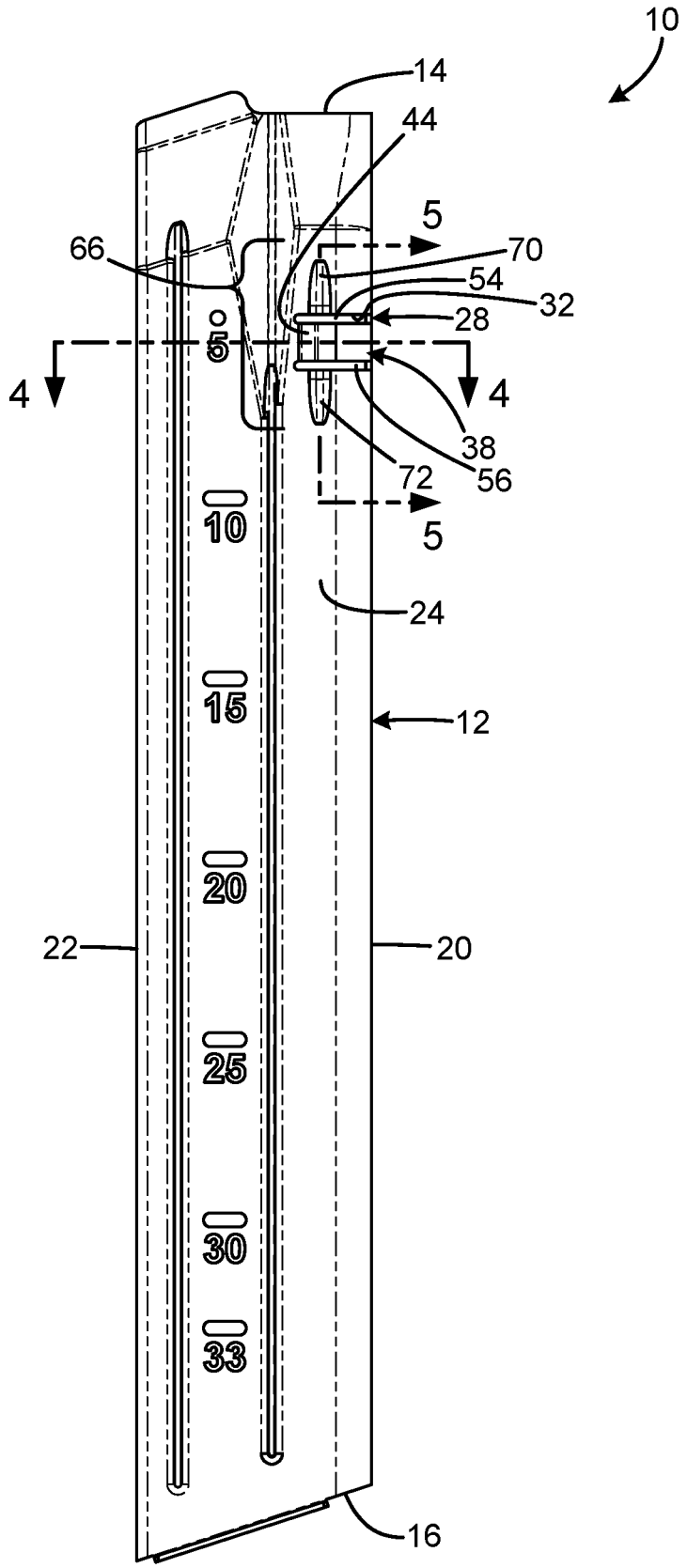
FIG. 3 is a right side view of the magazine with guard element of FIG. 1.
Figure 4:
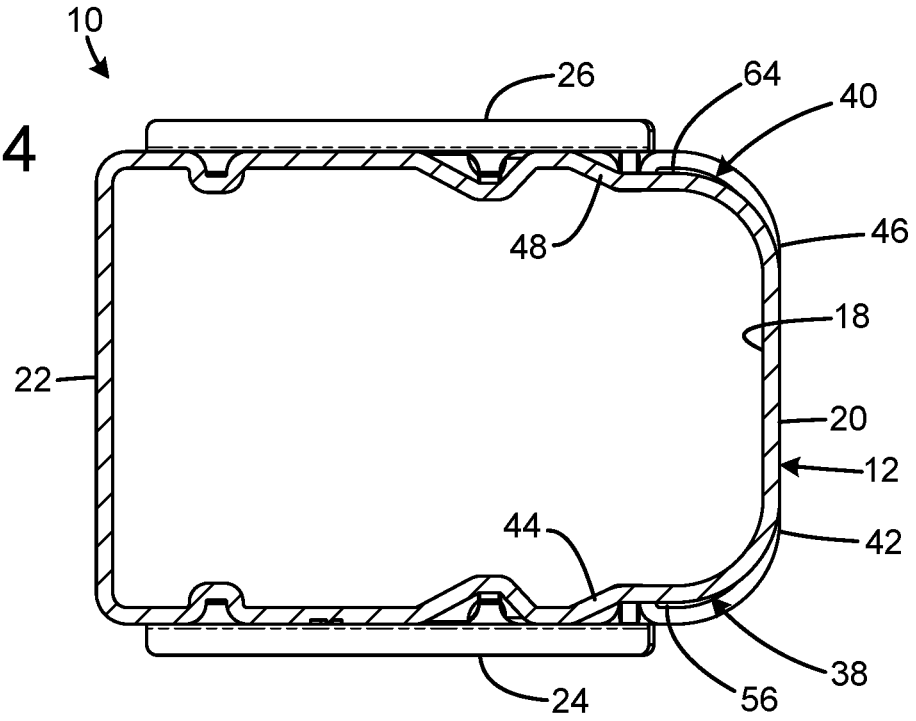
FIG. 4 is a top sectional view of the magazine with guard element of FIG. 1 taken along line 4-4 of FIG. 3.
Figure 5:
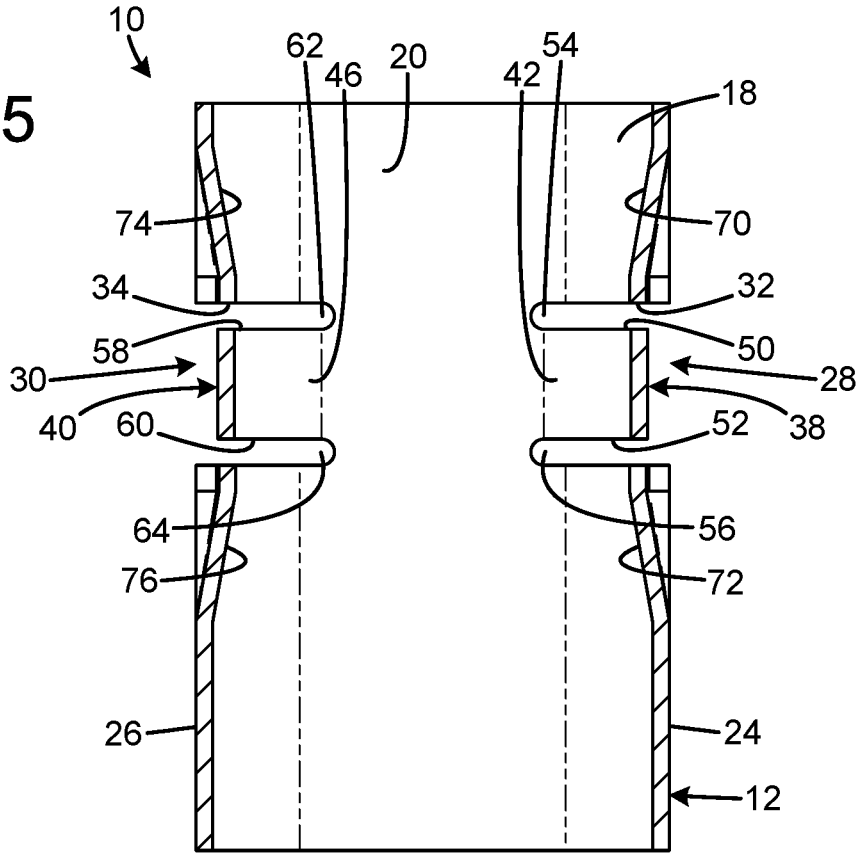
FIG. 5 is a front sectional view of the magazine with guard element of FIG. 1 taken along line 5-5 of FIG. 3.

An embodiment of the magazine of the present invention is shown and generally designated by the reference numeral 10.

FIGS. 1-5 illustrate the improved magazine with guard element 10 of the present invention. More particularly, the magazine with guard element 10 has a tubular body 12 having an upper end 14, a lower end 16, and defines an interior space 18. The tubular body also has opposed front and rear walls 20, 22 and opposed lateral sidewalls (right sidewall 24 and left sidewall 26). At least one of the opposed lateral sidewalls defines a magazine catch opening. In the current embodiment, the right sidewall defines a right magazine catch opening 28 at a right intermediate portion 66 along the length of the body between the upper and lower ends, and the left sidewall defines a left magazine catch opening 30 at a left intermediate portion 68 along the length of the body between the upper and lower ends. Each magazine catch opening has an upper limit including a downwardly-facing ledge surface (right downwardly-facing ledge surface 32 and left downwardly-facing ledge surface 34) configured to engage a firearm latch 36 (shown in FIG. 6). Each magazine catch opening has a recessed guard element (right recessed guard element 38 and left recessed guard element 40) configured to prevent intrusion of the firearm latch into the interior space. The right downwardly-facing ledge surface is immediately above the right recessed guard element. The left downwardly-facing ledge surface is immediately above the left recessed guard element.

In the current embodiment, the right and left recessed guard elements 38, 40 protrude into the interior space 18. The tubular body 12 has a wall thickness adjacent to the right and left recessed guard elements, and the right and left recessed guard elements have the same wall thickness as the tubular body. The tubular body is formed of an articulated sheet, and the right and left recessed guard elements are portions of the articulated sheet deflected internally into the interior space. Thus, the tubular body and the right and left recessed guard elements are an integral sheet of metal. The right recessed guard element is connected at a forward end portion 42 and rear end portion 44 to the tubular body, with the forward end portion connected to the front wall 20 and the rear end portion to the right sidewall 24. The left recessed guard element is connected at a forward end portion 46 and rear end portion 48 to the tubular body, with the forward end portion connected to the front wall 20 and the rear end portion to the left sidewall 26. The forward end portions are parallel to their associated sidewall.

The right recessed guard element 38 has an upper edge 50 and a lower edge 52. The tubular body 12 defines an upper slit 54 above the right recessed guard element and a lower slit 56 below the right recessed guard element. Thus, the tubular body is separated from the right recessed guard element by at least one of the upper and lower edges. Similarly, the left recessed guard element 40 has an upper edge 58 and a lower edge 60. The tubular body 12 defines an upper slit 62 above the right recessed guard element and a lower slit 64 below the right recessed guard element. Thus, the tubular body is separated from the left recessed guard element by at least one of the upper and lower edges.

The tubular body 12 includes a right upper ramp element 70 and a right lower ramp element 72 adjacent to the right recessed guard element 38 and a left upper ramp element 74 and a left lower ramp element 76 adjacent to the left recessed guard element 40. The ramp elements each provide a transitory slope between the recessed guard element and an interior surface vertically proximate the recessed guard element. The upper ramp elements are above their associated recessed guard elements, and the lower ramp elements are below their associated recessed guard elements. In the current embodiment, the ramp elements are each a deformed portion of the articulated sheet, which results in each ramp element having the same thickness as the associated recessed guard element. The right upper ramp element is separated from the right recessed guard element by a gap in the form of upper slit 54. The right lower ramp element is separated from the right recessed guard element by a gap in the form of lower slit 56. The left upper ramp element is separated from the left recessed guard element by a gap in the form of upper slit 62. The left lower ramp element is separated from the left recessed guard element by a gap in the form of lower slit 64. Each of the ramp elements has a triangular form in the current embodiment.

Figure 6:
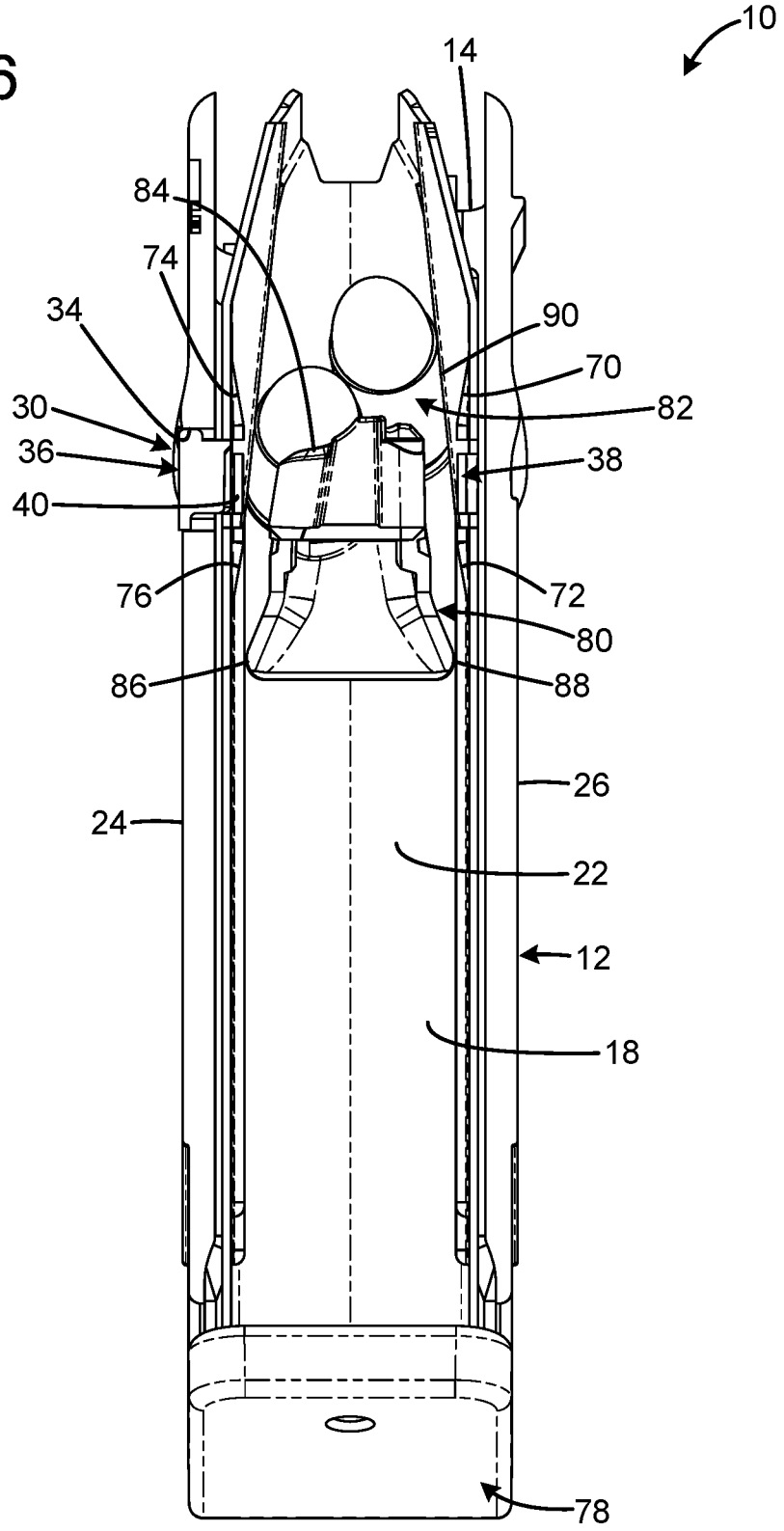
FIG. 6 is a front sectional view of the magazine with guard element of FIG. 1.

FIG. 6 illustrates the improved magazine with guard element 10 of the present invention. More particularly, the magazine with guard element 10 is shown in a fully assembled, partially loaded condition with a magazine latch 36 received by the left magazine catch opening 30 and contacting the left downwardly-facing ledge surface 34. A floor plate 78 is removably attached to the lower end 16 of the tubular body 12. A follower 80 is closely received within the interior space 18 of the tubular body. Two cartridges 82 are positioned on the top 84 of the follower. The follower urges the cartridges upward to the upper end 14 of the tubular body under the influence of a coil spring (not shown) also received within the interior space of the tubular body.

As can be appreciated in FIG. 6, the left recessed guard element 40 prevents the magazine latch 36 from penetrating sufficiently far into the interior space 18 of the tubular body 12 to obstructed movement of either the cartridges 82 or the follower 80 during the loading of cartridges or the stripping of cartridges during firearm operation. Furthermore, the right and left upper and lower ramp elements 70, 74, 72, 76 provide smooth transition surfaces for the right side 86 and left side 88 of the follower and the case exteriors 90 of the cartridges to pass over the right and left recessed guard elements 38, 40 without being obstructed as the follower and cartridges move up and down within the interior space of the tubular body.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a magazine has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the magazine of the current invention is suitable for use with rifles as well as the pistols described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An ammunition magazine for a firearm having a magazine well and a firearm latch movable into and out of the magazine well, the magazine comprising;

a tubular body having a lower end and an upper end and an interior wall surface defining an interior space;

the tubular body having opposed lateral sidewalls, and opposed front and rear walls; at an intermediate portion along the length of the body between the upper and lower ends, at least one of the opposed lateral sidewalls defining a magazine catch opening;

the magazine catch opening having an upper limit including a downwardly-facing ledge surface configured to engage a latch;

a recessed guard element at the magazine catch opening configured to prevent intrusion of the firearm latch into the interior space, wherein an interior surface of the recessed guard element protrudes inward of the interior wall surface of the tubular body into the interior space;

wherein the tubular body is formed of an articulated sheet, and the recessed guard element is a portion of the articulated sheet deflected internally into the interior space; and wherein the recessed guard element has an upper edge and a lower edge, and wherein the tubular body is separated from the recessed guard element by at least one of the upper and lower edges.

2. The ammunition magazine of claim 1 wherein the tubular body has a wall thickness adjacent to the recessed guard element, and the recessed guard element has the same wall thickness.

3. The ammunition magazine of claim 1 wherein the tubular body and recessed guard element are an integral sheet of metal.

4. The ammunition magazine of claim 1 wherein the recessed guard element is connected at a forward end and a rear end to the tubular body.

5. The ammunition magazine of claim 4 wherein the tubular body defines a slit above and below the recessed guard element.

6. The ammunition magazine of claim 1 wherein the downwardly-facing ledge surface is immediately above the recessed guard element.

7. The ammunition magazine of claim 1 wherein the recessed guard element has a forward end portion connected to the front wall and a rear end portion connected to one of the sidewalls.

8. The ammunition magazine of claim 7 wherein the forward end portion is parallel to the one of the sidewalls.

9. The ammunition magazine of claim 1 including a ramp element adjacent to the recessed guard element and providing a transitionary slope between the recessed guard element and an interior surface portion vertically proximate the recessed guard element.

10. The ammunition magazine of claim 9 wherein the ramp element is below the recessed guard element.

11. The ammunition magazine of claim 1 including a ramp element adjacent to the recessed guard element and providing a transitionary slope between the recessed guard element and an interior surface portion vertically proximate the recessed guard element, and wherein the ramp element has the same thickness as the recessed guard element.

12. The ammunition magazine of claim 11 wherein the ramp element is separated from the recessed guard element by a gap.

13. The ammunition magazine of claim 11 wherein the ramp element has a triangular form.

14. An ammunition magazine for a firearm having a magazine well and a firearm latch movable into and out of the magazine well, the magazine comprising;

a tubular body having a lower end and an upper end and defining an interior space;

the tubular body having opposed lateral sidewalls, and opposed front and rear walls;

at an intermediate portion along the length of the body between the upper and lower ends, at least one of the opposed lateral sidewalls defining a magazine catch opening;

the magazine catch opening having an upper limit including a downwardly-facing ledge surface configured to engage a latch;

a recessed guard element at the magazine catch opening configured to prevent intrusion of the firearm latch into the interior space;

a ramp element adjacent to the recessed guard element and providing a transitionary slope between the recessed guard element and an interior surface portion vertically proximate the recessed guard element;

wherein the ramp element has the same thickness as the recessed guard element; and wherein the ramp element is a deformed portion of the articulated sheet.

* * * * *